US005511702A

United States Patent [19]

Yang

[11] Patent Number: 5,511,702

[45] Date of Patent: Apr. 30, 1996

[54] WRIST STRAP FOR CARRYING PAGERS

[76] Inventor: Chin Y. Yang, 8F, 149, Hang Joe S. Road, Sec. 1, Taipei, Taiwan

[21] Appl. No.: 395,987

[22] Filed: Feb. 28, 1995

[51] Int. Cl.[6] ..... A45C 3/14; A45F 3/14

[52] U.S. Cl. ..... 224/219; 224/165; 224/170; 224/176; 224/221; 224/235; 224/267; 224/901; D3/218; 206/305

[58] Field of Search ..... 224/165, 170, 224/176, 219, 222, 267, 252, 221, 235, 907, 901, 929, 930, 253; 206/305; D3/215, 218

[56] References Cited

U.S. PATENT DOCUMENTS

| | | | |
|---|---|---|---|
| 2,954,621 | 4/1959 | Mosher, Jr. et al. | 224/222 |
| 4,746,043 | 5/1988 | Booker | 224/907 |
| 5,170,917 | 12/1992 | Tourigny | 224/219 |

OTHER PUBLICATIONS

Journal of A.M.A. vol. 168 Oct. 18, 1958.

*Primary Examiner*—Henry J. Recla
*Assistant Examiner*—Timothy L. Maust
*Attorney, Agent, or Firm*—Morton J. Rosenberg; David I. Klein

[57] ABSTRACT

A wrist strap used for carrying a pager is provided. The wrist strap includes a strap which provides accommodation for a pager within a pocket, the pager being visible through a transparent surface of a display window for reading messages from the pager. One end of the wrist strap extends to form a band and the other end is provided with a side loop. With the aid of an easy-to-use fastening system disposed on the band, the band can pass around a user's wrist and through the side loop, and then folded over the side loop to be fastened to itself. The band also forms a closure for the pocket as it passes around the user's wrist. Thus, users can wear the strap on their wrists and conveniently read the messages shown in the display window of the pager.

1 Claim, 3 Drawing Sheets

WRIST STRAP FOR CARRYING PAGERS

BACKGROUND OF THE INVENTION

Along with the advancement of scientific technologies, many new electronic products have been developed. Pagers have become a very popular communication means, which transmit messages by means of characters shown in the display window of the pager. Most users carry a pager by utilizing a clip to attach it to their belts and when they receive signals they must take it off or incline their head to read messages from the pager. Although such actions in an average indoor life may not bring them much trouble, many situations are that they receive signals when they are engaging in outdoor activities, such as driving a car or riding a motorcycle. On these occasions inclining their head to read messages from a pager may bring them into danger, and it is not easy to correctly perceive messages from the pager; thus resulting in a disadvantage of the current system which can be improved upon.

SUMMARY OF THE INVENTION

In view of the above discussion, the primary object of the present invention is to provide a useful carrying means which can accommodate a pager and attach it to a user's wrist. Users can then carry the pager wherever they go and easily read messages by just raising their hand and taking a quick glance at the display window. As a result, the present invention can obtain optimum convenience.

BRIEF DESCRIPTION OF THE DRAWINGS

The structure, features and advantages of the invention will become apparent by reading the following detailed description of the preferred embodiments and by reference to the accompanying drawings in which.

DETAILED DESCRIPTION OF PREFERRED EMBODIMENTS

Figure 1:
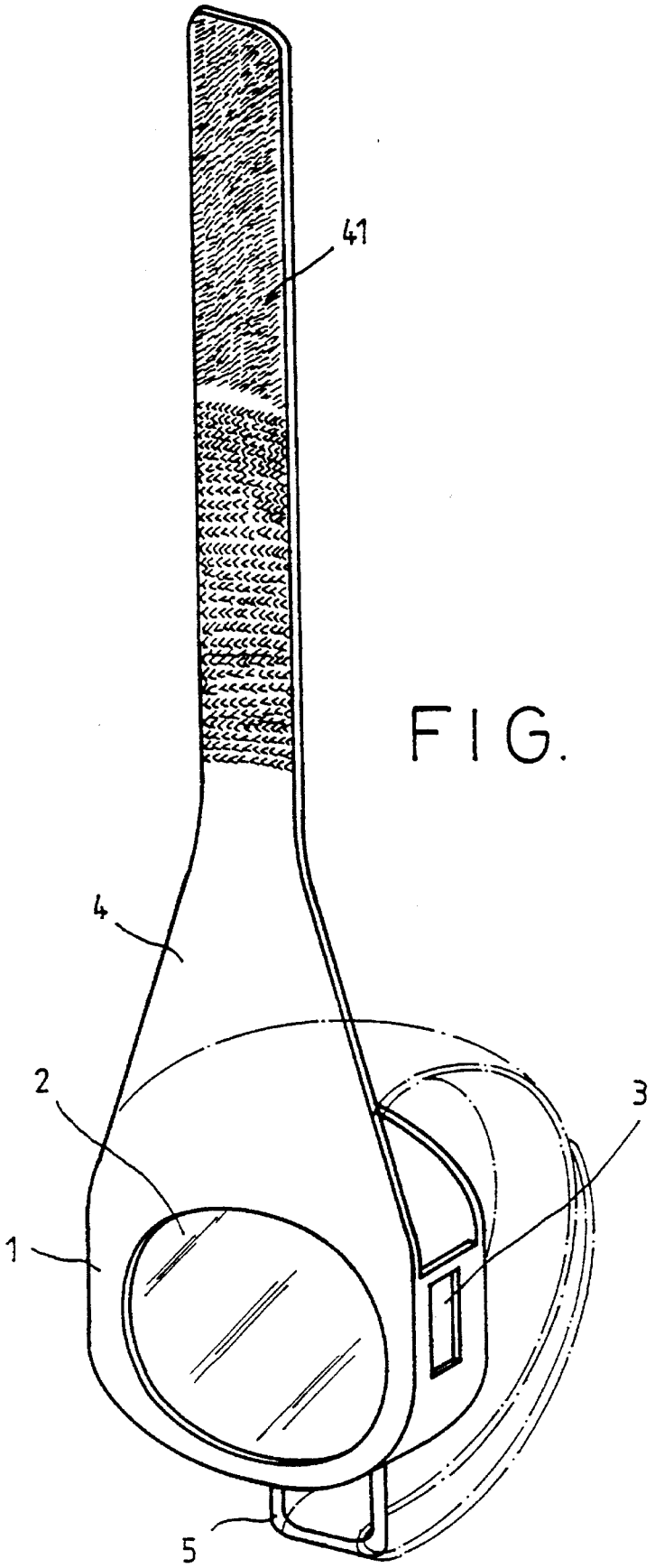
FIG. 1 is a perspective view showing the outer appearance of an embodiment of a wrist strap according to the present invention.
Figure 2:
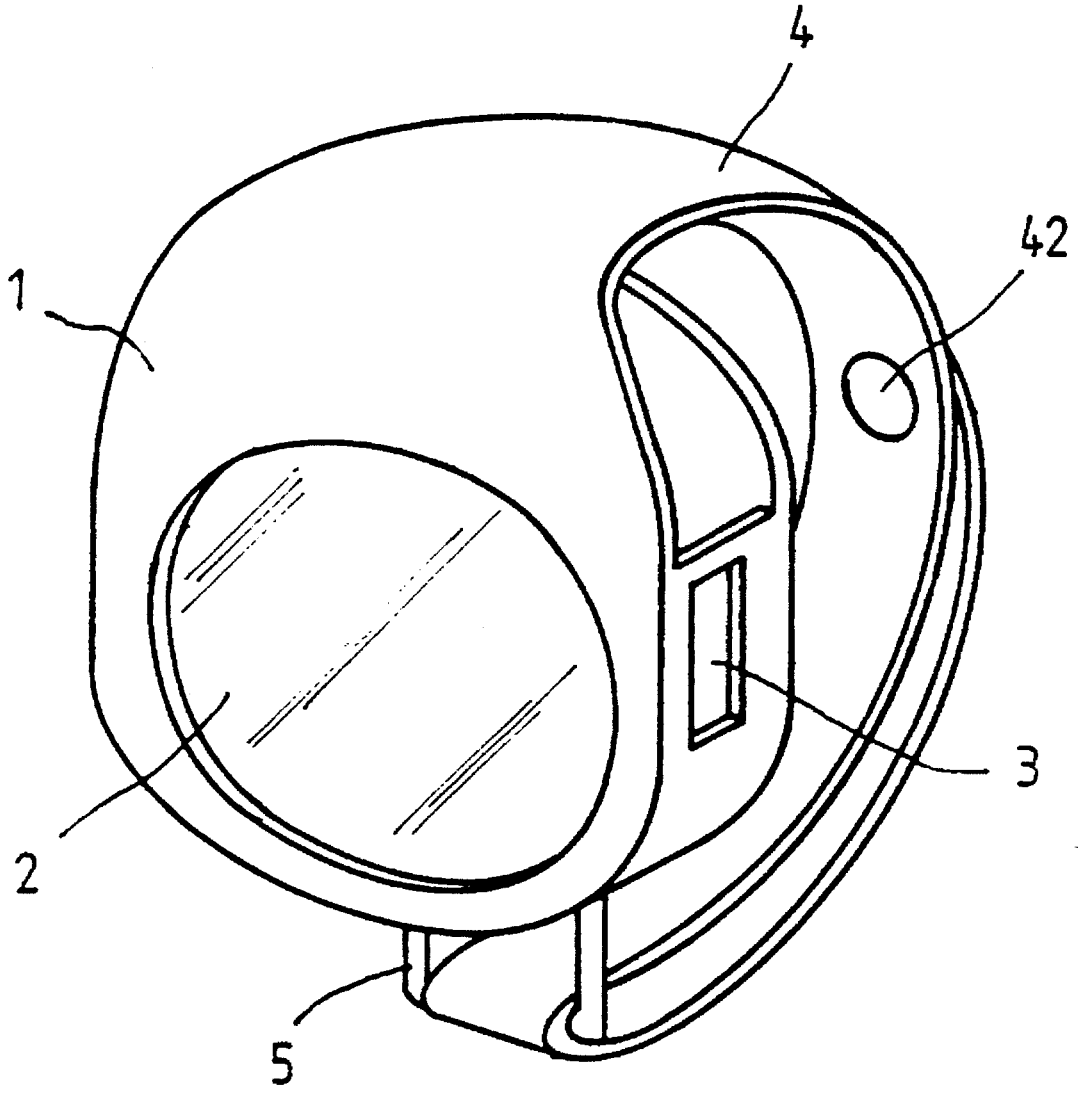
FIG. 2 shows another embodiment of a wrist strap.

Referring to FIGS. 1 and 2, the main body of this invention is a strap 1 having a pocket 7 formed on the inner surface thereof, the shape of which may be designed to make it suitable to receive pagers having various outer configurations, particularly to pagers of a miniature type, that is the development trend that pager design has followed. On the outside surface of the strap 1 a see-through window 2 is formed therethrough and an opening 3 is formed through a side wall of the pocket 7 to provide access to the switches of a pager placed therein. Also, the outside surface of the strap extends from one end to form a band 4, and the other end is provided with a side loop 5. Arranged on the band 4 is a fastening means such as a Velcro tape 41 as shown in FIG. 1. The band 4 is passed around the user's wrist and through the side loop 5, and is then folded over the side loop 5 to be fastened with itself for securement on the user's wrist, providing the user with a convenient and easy way to put on the wrist strap. The foregoing fastening means may also take other forms. As an illustrative example, a button mechanism 42 is shown in FIG. 2, but other means such as resilient metal loops or bracelet-like clips can also be adopted without departing from the spirit of the invention and should be included in the scope of this invention. In passing the band 4 around a user's wrist, such forms a closure for the pocket 7, as shown in phantom in FIG. 1, to retain the pager therein.

Figure 3:
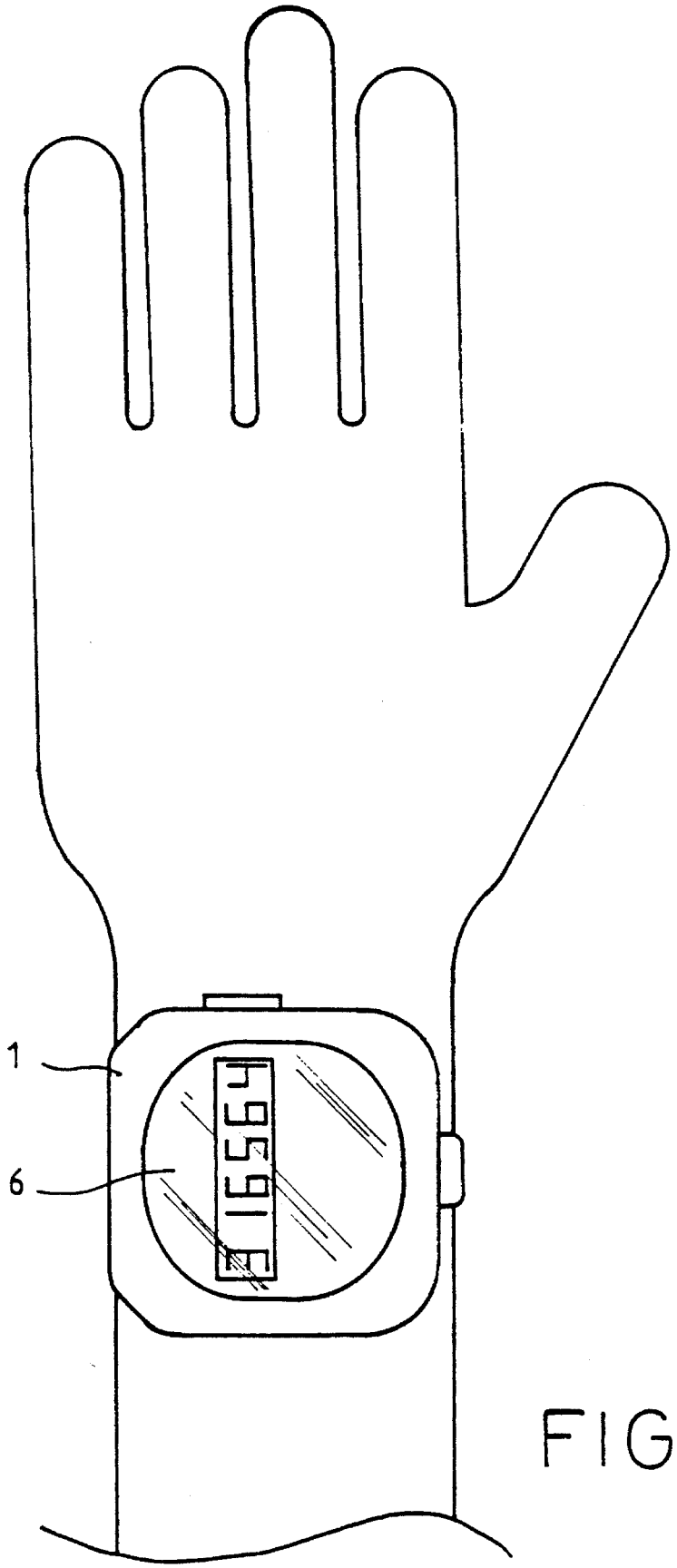
FIG. 3 is a schematic view showing how a wrist strap of the present invention is used in the field.

In the field, a pager 6 is placed in the strap 1 and users can adapt the band 4 to their wrist size and then put on the wrist strap as shown in FIG. 3. When a user wants to read messages from the pager, all he needs to do is just raise his hand and glance at the display window of the pager, just like reading time from a wrist watch. The most important advantage is that it means a significant reduction in danger and provides a vehicle driver a safe and quick way to get messages from a pager. From the foregoing it can be seen that the wrist strap 1 can be put on a user's wrist for carrying a pager so that the user can read messages from the pager in a safe and efficient way while he is driving a vehicle, and of which the carrying convenience is unbeatable as compared to existing pager carrying means.

What is claimed is:

1. A wrist strap for carrying a pager, comprising:

a strap having (1) a pocket formed on a rear side thereof for receiving a pager therein, said pocket having an open upper end and a pair of opposing side walls, (2) a through opening formed in one of said pair of side walls for accessing a pager's switches, and (3) a transparent window formed in a front side of said strap for viewing a pager's display therethrough, said strap having an elongated band extending from a first end thereof;

a side loop coupled to a second end of said strap, said band adapted to be wrapped around a user's wrist for passage of a distal end of said band through said side loop and folding thereover to overlap an intermediate portion of said band with said distal end, said band forming a closure for said open end of said pocket when wrapped around a user's wrist for retaining a pager therein; and, fastening means coupled to said band for releasably coupling said distal end of said band to said intermediate portion thereof.

* * * * *